US005325680A

United States Patent [19]

Baroso-Lujan et al.

[11] Patent Number: 5,325,680

[45] Date of Patent: Jul. 5, 1994

[54] SELF-COOLING BEVERAGE CONTAINER WITH EVACUATED REFRIGERANT RECEIVING CHAMBER

[76] Inventors: Francisco J. Baroso-Lujan, Cuicuilco No. 77, Col. Vertiz Narvarte, CP 03650, Mexico; Ernesto M. Galvan-Duque, Seneca 41, Col. Polanco, CP 11560, Mexico

[21] Appl. No.: 38,479

[22] Filed: Mar. 29, 1993

[51] Int. Cl.[5] ..... F25D 3/10

[52] U.S. Cl. ..... 62/294; 62/457.3; 62/457.9

[58] Field of Search ..... 62/294, 457.3, 457.9

[56] References Cited

U.S. PATENT DOCUMENTS 4,688,395 8/1987 Holcomb ..... 62/294

5,214,933 6/1993 Altchison et al. ..... 62/294

FOREIGN PATENT DOCUMENTS 112700 2/1972 Mexico .

*Primary Examiner*—John M. Sollecito

*Attorney, Agent, or Firm*—Willian Brinks Hofer Gilson & Lione

[57] ABSTRACT

A beverage can be cooled to a temperature lower than the ambient temperature by canning said beverage within a can which is internally provided with an integral cooling system comprising a compartment containing a liquid refrigerant fluid such as Freon 22 under a relatively elevated pressure, a compartment under reduced pressure connected with said high pressure refrigerant compartment by means of a partition, and a partition breaking device for perforating said partition to permit the expansion and flashing of the refrigerant fluid into said compartment under reduced pressure, in order to produce an absorption of heat from said beverage by the evaporation of said liquid refrigerant.

17 Claims, 2 Drawing Sheets

SELF-COOLING BEVERAGE CONTAINER WITH EVACUATED REFRIGERANT RECEIVING CHAMBER

FIELD OF THE INVENTION

The present invention refers to the canning and storage of all types of beverages within the food and beverage industries and, more particularly, it relates to a beverage container having an integral cooling system which permits the reduction of the temperature of the beverage contained in the container without the need of an external cooling source.

BACKGROUND OF THE INVENTION

It is very well known that at the present time the storage, transportation and consumption of cans for containing food-type and refreshing beverages such as fruit and vegetable juices, dairy liquid or pasty products, soft drinks, beers and the like, is a very important and popular economical activity throughout the world. Canned beverages, on the other hand, have a very practical usefulness in the art, due to the advantages shown thereby for their transportation and handling, which permits persons of all ages to easily handle this type of containers without running the risk of accidental breakage such as is common practice when handling glass containers or bottles.

However, the above described type of containers or cans show the serious drawback that they are highly heat conducting devices that do not assist in maintaining a suitable temperature for the contents thereof which may be appealing to the consumer of canned beverages, particularly when said cans have been exposed for a considerable period of time to hot weather or the mere solar radiation, for which reason said canned beverages must be subjected to a suitable cooling process before consumption thereof, either by direct or indirect contact with ice or by using a refrigeration device. This may prove to be rather difficult in places with low population as well as in remote locations such as secondary roads and the like, where it is practically impossible to have enough availability of ice or other refrigeration means. This, in turn, forces the consumers to necessarily consume the canned beverages at the ambient temperature that, in most of these cases, is unduly hot to provide a tasty and refreshing beverage.

On the other hand, in remote or semi-wild areas where the availability of electrical energy is scarce or practically inexistent or in areas populated by low income people who find it rather difficult to purchase a refrigerator, the problem of being forced to consume all types of canned beverages at ambient temperature remains, and in these areas the said beverages have to be consumed at temperatures that do not aid to render said canned beverages a tasty and refreshing article of consumption, thus defeating their main purpose, namely, that of being palatable and refreshing.

Although workers in the art have proposed various solutions to the above described problems, all of them have involved the use of external cooling, that is, cooling of the canned beverages by the application of ice externally thereof, for instance, in small and economical thermally insulated receptacles and the like, which devices only partially solve the problem because the same will remain for areas where no ice is available. To the applicant knowledge, no solution for cooling a canned beverage by means of internal cooling within the can has ever been proposed.

OBJECTS OF THE INVENTION

Having in mind the defects of the prior art cooling systems for canned beverages, it is an object of the present invention to provide a container for canning, storing and expending beverages, that will permit to cool said beverages without the need of external cooling.

It is another object of the present invention to provide a container for beverages of the above mentioned character, which will be of a very simple construction and will cool the beverage contained therein by a simple and fast operation.

One other object of the present invention is to provide a container for beverages of the above described character, which will be economical and absolutely safe for being handled and stored.

One other and more particular object of the present invention is to provide a container for beverages of the above character, which will permit the cooling of the beverage at the time of consumption thereof, without the need of using external cooling systems.

The foregoing objects and others ancillary thereto are preferably accomplished as follows:

According to a preferred embodiment of the present invention, a can type container for beverages is provided with an internal cooling system which comprises a first compartment within the container suitable for containing a refrigerant fluid under relatively high pressure, a second compartment within the container suitable for containing air under reduced pressure or a vacuum, said second compartment being attached to said first compartment but separated therefrom by means of a partition, and a partition breaking device actuatable from the outside of the container for either breaking said partition or punching an orifice in said partition to permit the refrigerant fluid to flash towards and expand into said second compartment which is under reduced pressure, thus producing a decrease in the temperature of the beverage contained in the container which is in direct contact with the walls of said compartments.

BRIEF DESCRIPTION OF THE DRAWINGS

The novel features that are to be considered characteristic of the present invention are set forth with particularity in the appended claims. The invention itself, however, both as to its organization and its method of operation, together with additional objects and advantages thereof, will best be understood from the following description of a specific embodiment when read in connection with the accompanying drawing, in which:

DETAILED DESCRIPTION

Figure 1:
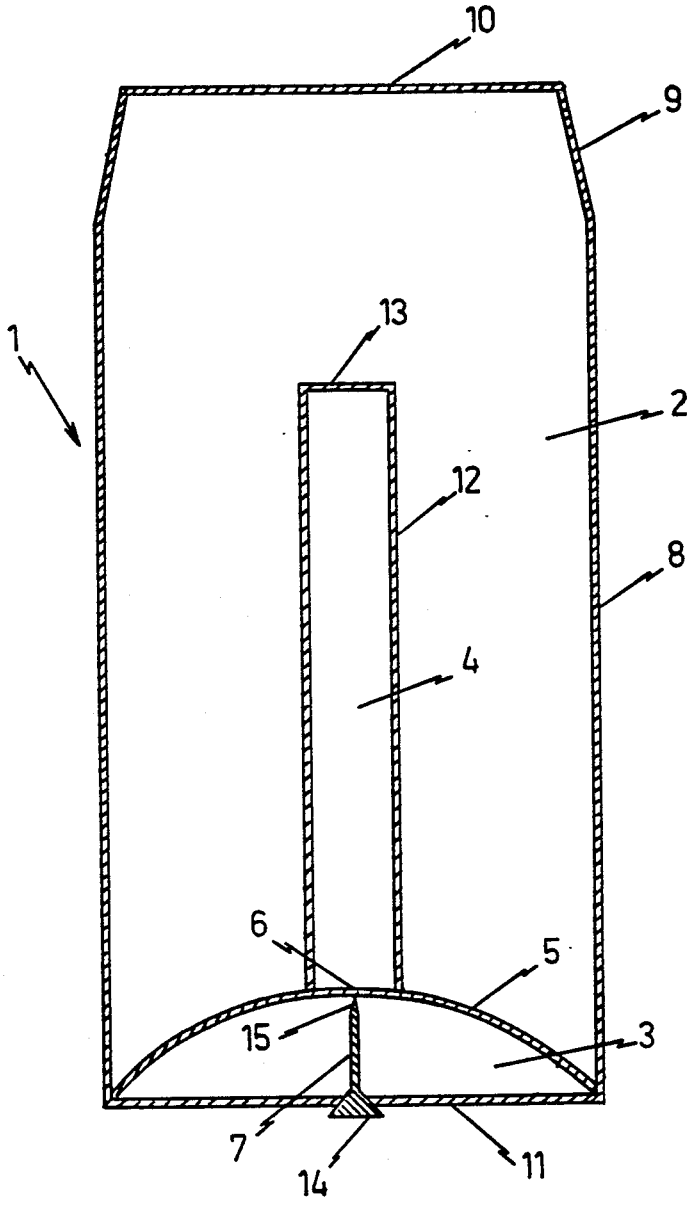
FIG. 1 is a cross sectional elevational view of a can type container for beverages having an integral cooling system built in accordance with a first embodiment of the present invention.

Having now more particular reference to the drawings and more particularly to FIG. 1 thereof, there is shown a can type container for beverages identified by the general reference numeral 1, which includes an integral cooling or refrigerating system built in accordance with a specific embodiment of the present invention and which essentially comprises a preferably cylindrical wall 8 provided with a frusto conical top section 9, a flat top or cover 10 which normally has means for opening the container, and a flat bottom 11, said container 1 comprising a first compartment 2 for containing the beverage, a second compartment 3 separated from compartment 2 by means of a convex wall 5 preferably arranged adjacent to the bottom 11 of the container 1, such that the peripheries of both said bottom 11 and said convex wall 5 be coincident, said second compartment 3 being provided for containing a non-toxic non-flammable commercial refrigerant fluid under high pressure, and a third internal compartment 4 which comprises a cylindrical wall 12 of a diameter which is much smaller than the diameter of the cylindrical wall 8 of the container 1, concentrically arranged thereto, and a flat top 13 to hermetically separate said compartment 4 from the compartment 2 which contains the beverage. The third compartment 4 is preferably provided with air under reduced pressure, either partial or complete vacuum and the bottom thereof is arranged over the central portion of the wall 5 of compartment 3 and hermetically attached thereto, such that compartments 3 and 4 be separated by means of a portion of said wall 5 which therefore forms a partition 6 between both compartments for a purpose which will be clearly explained hereinbelow.

A punching device 7 is provided such that the base 14 thereof be hermetically attached to the bottom 11 of the container 1 which at the same time forms the bottom of the compartment 3 and its sharp upper end 15 be directly in contact or abutting against the central point of the partition 6. By this arrangement, the punching device 7 may be pushed upwardly from the outside of the container by pushing said punching device together with the bottom 11 of the container so as to perforate an orifice through partition 6, the central section of which may be previously weakened for this purpose, in order to permit the flashing and expansion of the refrigerant fluid contained in compartment 3 into compartment 4 which is under reduced pressure. The refrigerant fluid, due to the thermodynamic (adiabatic) expansion suffered, is flashed or evaporated thus reducing the temperature at the expense of the heat contained in the environment, whereby in a very short time the temperatures will tend to reach to a stable equilibrium in the whole system, by which reason the expanded gas produced by the refrigerant fluid will tend to absorb heat from the beverage until the temperature of the three compartments 2, 3 and 4 is thermodynamically in equilibrium.

Figure 2:
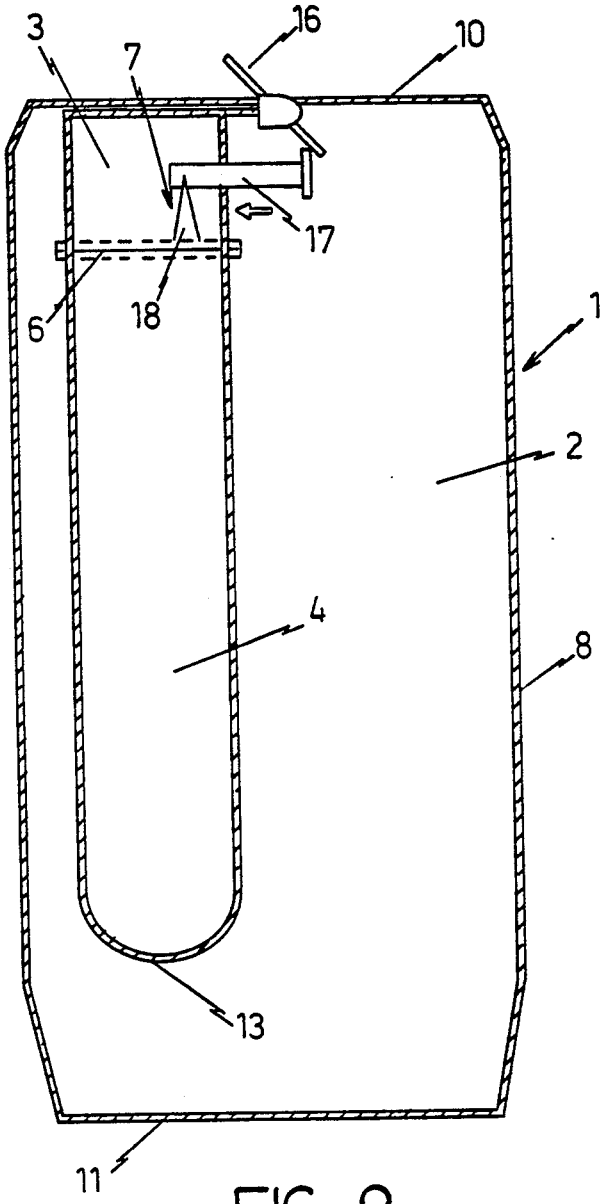
FIG. 2 is a cross sectional elevational view of a can type container for beverages having an integral cooling system built in accordance with a second embodiment of the present invention.

FIG. 2 shows a second embodiment of the present invention wherein the same reference numerals used in FIG. 1 designate similar parts. The integral cooling system in the instance of the embodiment shown in FIG. 2 is arranged such that the second compartment 3 is attached to the top 10 of the container 1 and the third compartment 4 is an extension of said second compartment 3, said compartment 4 being closed at its bottom by means of an integral cover 13. Compartment 4 is separated from compartment 3 by means of a rupturable partition 6. A partition breaking device 7 is arranged through the wall of compartment 3 and comprises a lever 18 which actuates on a weakened portion of partition 6 and a pusher member 17 one end of which is attached to lever 18 and the other end of which is actuatable to be pushed in the direction of the arrow by the tongue 16 which is also used for opening the top 10 of the can, as clearly illustrated in FIG. 2 of the drawings.

The basic operation of the system of the present invention comprises introducing a beverage for human consumption into compartment 2 of the container 1, storing a refrigerant fluid under high pressure into compartment 3, which is kept hermetically stored in said compartment until the time in which it is desired to cool the beverage is reached, and providing compartment 4 with a suitable vacuum. When it is desired to cool the beverage, the punching device 7 of FIG. 1 or the partition breaking device 7 of FIG. 2 is pushed against partition 6 in order to produce a perforation therein, thus causing the refrigerant fluid under high pressure to violently pass through said perforation from a high pressure system in compartment 3 to a low pressure system in compartment 4. This sudden change in pressure produces the flashing and expansion of the refrigerant fluid, the temperature of which is drastically reduced because of the thermodynamic process involved, whereby the low temperature of the thus produced gas will be transmitted to the beverage contained in compartment 2 of the container 1, thus lowering the temperature of said beverage until the system reaches thermodynamic equilibrium by equalizing the temperatures in the whole system, which condition will take only a few minutes or even seconds of time. Thus, the operation of the system of the present invention will produce a cooled beverage in a matter of a few minutes or even in seconds, depending on the dimensions of the different compartments and on the characteristics of the refrigerant fluid used.

The present invention will be more fully understood in the following examples which are given only for illustrative but non-limitative purposes.

EXAMPLE 1

A prototype container according to the invention was built by providing a cylindrical can having a diameter of 6 cm and a height of 13 cm. A compartment for high pressure refrigerant fluid, in the shape of a spherical sector having a height of 2 cm was superposed to the flat bottom of said container, and a cylindrical vertical expansion compartment having a diameter of 1.5 cm and a height of 8 cm was attached over the spherical wall of said compartment for refrigerant fluid. The thus manufactured system therefore provided a first compartment for beverage having a volume of approximately 316 cc, a second compartment for refrigerant fluid under high pressure having a volume of approximately 38 cc and a vacuum or expansion third compartment having a volume of approximately 14 cc.

The first compartment was filled with water at an ambient temperature of approximately 20° C., the second compartment was filled with liquid Freon 22 (chloro-difluoro-methane R-22) under an absolute pressure of about 8.2 kg/cm$^2$ and a vacuum was produced in the third compartment to provide an absolute pressure of about 0.07 kg/cm$^2$. The partition between the second and third compartments was punched to permit the expansion of the Freon 22. The temperature of the water contained in the first compartment was measured after a period of time of 2 minutes and it was found to be of approximately 10.4° C.

EXAMPLE 2

The experiment described in example 1 was repeated by using the same prototype container but using a different refrigerant fluid which in this case was Freon 21 (dichloro-fluoro-methane R-21) at an absolute pressure of about 1.33 kg/cm$^2$. After punching the partition the temperature of the water was measured as in example 1, giving a value of approximately 15.6° C.

EXAMPLE 3

The experiment described in example 1 was repeated by using the same prototype container but using a different refrigerant fluid which in this case was difluoroethane (R-152a) at an absolute pressure of about 4.6 kg/cm$^2$. After punching the partition the temperature of the water was measured as in example 1, giving a value of approximately 12° C.

From the above examples it may be seen that apparently the best refrigerant fluid is Freon 22, because besides achieving the best results, namely, the lowest temperature of the beverage, is absolutely non-toxic. On the other hand, as it may be seen from the above, the container of the present invention which has the appearance of a normal can for beverages like those broadly used throughout the world, offer the consumers of all types of canned beverages a practical and functional solution to the inconveniences of not having a cooling or refrigerating system available for cooling the canned beverages, inasmuch as by the very simple solution of operating the punching device of the system of the present invention, they will be able to produce in a very short time a nicely cooled beverage which will be both palatable and refreshing.

Also, it is to be pointed out that the use of cans built in accordance with this invention will considerably reduce the energy consumption of the traditional refrigerating or cooling apparatus where canned beverages are normally stored for consumption, inasmuch as it will not be necessary to store the beverages canned in cans built with the integral cooling system of the invention in such apparatus, because they can be sold directly from the shelf to the consumers.

Although certain specific embodiments of the invention have been shown and described above, it must be understood that many modifications thereof are possible. The present invention, therefore, must not be restricted except insofar as is necessitated by the prior art and by the spirit of the appended claims.

What is claimed is:

1. A self-cooling beverage container comprising:

a can having a cylindrical wall extending at least through a major portion of a height of the can, a top having means for opening the can and a bottom;

a first compartment defined by the mall, the top and the bottom, containing a beverage;

a second compartment containing a refrigerant fluid under relatively high pressure;

a third compartment containing a gas under partial vacuum;

a partition separating the third compartment from the second compartment; and a partition breaking means actuatable from outside of the container for perforating said partition to permit the refrigerant fluid to flash towards and expand into said third compartment for producing a decrease in the temperature of the beverage contained in said first compartment.

2. A self-cooling beverage container according to claim 1 wherein said second compartment is defined by a convex wall arranged within the can and having a peripheral edge hermetically attached to and coincident with the flat bottom for forming the first compartment defined by said cylindrical wall, said top and said convex wall and the second compartment defined by said bottom and said convex wall; wherein said third compartment comprises an inner cylindrical receptacle concentrically arranged within said can, said inner cylindrical receptacle having an open bottom hermetically attached to said convex wall and a closed top for hermetically separating said inner cylindrical receptacle from an interior of said can; wherein a portion of said convex wall forms the partition between said second and said third compartments; and wherein said partition breaking device comprises punching means arranged within said second compartment for punching an orifice through said partition.

3. A self-cooling beverage container according to claim 2 wherein said partition comprises an area of said convex wall which has been weakened in order to facilitate punching of the convex wall by said punching means.

4. A self-cooling beverage container according to claim 2 wherein said punching means comprise an elongated rod having a lower end attached to the bottom of the can and an upper end including a sharp point abutting said partition, whereby by pushing said bottom, said sharp point perforates said partition.

5. A self-cooling beverage container according to claim 1 wherein said second and third compartments are provided by a cylindrical receptacle having an interior surface and attached to the top of said can; wherein said partition comprises a circular partition hermetically attached to the interior surface of said cylindrical receptacle; wherein the circular partition has a weakened portion thereon; and wherein said partition breaking device comprises a lever attached to the weakened portion of said partition and to a pusher member, said member being actuatable by a tongue provided on the top of said can, said tongue also serving to open said can at the top thereof.

6. A self-cooling beverage container according to claim 1 wherein said refrigerant fluid is a non-toxic non-flammable refrigerant fluid.

7. A self-cooling beverage container according to claim 6 wherein said non-toxic non-flammable refrigerant fluid is dichloro-fluoro-methane.

8. A self-cooling beverage container according to claim 1 wherein said refrigerant fluid is at least one of dichloro-fluoro-methane and difluoroethane.

9. A self-cooling beverage container according to claim 1 wherein the refrigerant fluid is Freon 21.

10. A self-cooling beverage container, according to claim 1, wherein the gas under reduced pressure comprises air at an absolute pressure of about 0.07 kg/cm$^2$.

11. A self-cooling beverage container comprising:

a can having a cylindrical wall extending at least through a major portion of a height of the can, a flat top having means for opening the can, and a bottom;

a first compartment within said can defined by the cylindrical wall, the flat top and the bottom of the can, for containing a beverage within said first compartment;

a second compartment within said can for containing a refrigerant fluid under relatively high pressure, said second compartment being arranged within said first compartment and having an upper end which is attached to the interior surface of the flat top of the can;

a third compartment within said can for containing air under reduced pressure, which is an extension of said second compartment, said second and third compartments being formed by a cylindrical receptacle and separated by a circular partition hermetically attached to the interior surface of said cylindrical receptacle;

a partition breaking device arranged through a wall of the second compartment for perforating said partition to permit the refrigerant fluid to pass towards and expand into said third compartment for producing a decrease in the temperature of the beverage contained in said first compartment; and a pusher member connected to said partition breaking device and actuatable from outside of the container by a tongue provided on the top of said can, said tongue also serving to open said can at the top thereof.

12. a self-cooling beverage container, according to claim 11, wherein said second compartment is defined by the circular partition separating the second compartment from the third compartment, an upper end which is attached to the interior surface of the flat top of the can and a cylindrical side wall which comprises an opening for permitting the insertion of said pusher member.

13. A self-cooling beverage container, according to claim 11, wherein said third compartment comprises an inner cylindrical receptacle formed of a cylindrical side wall collinear with said second compartment, said third compartment being defined by the circular partition at its top and said cylindrical side wall, which is closed at its bottom.

14. A self-cooling beverage container, according to claim 11, wherein said circular partition comprises an area which has been weakened in order to facilitate perforating of the circular partition by said breaking device.

15. A self-cooling beverage container, according to claim 14, wherein said breaking device comprises a lever which actuates on said weakened area of said circular partition, the pusher member being attached to said lever, whereby by pushing said pusher member into the second compartment, said lever will perforate the circular partition, thus permitting the refrigerant fluid to pass towards and expand into said third compartment.

16. A self-cooling beverage container, according to claim 11, wherein said refrigerant fluid is at least one of dichloro-fluoro methane and difluoroethane.

17. A self-cooling beverage container, according to claim 11, wherein the refrigerant fluid is Freon 21.

* * * * *

UNITED STATES PATENT AND TRADEMARK OFFICE

CERTIFICATE OF CORRECTION

PATENT NO. : 5,325,680

DATED : July 5, 1994

INVENTOR(S) : Barroso-Lujan et al.

It is certified that error appears in the above-identified patent and that said Letters Patent is hereby corrected as shown below:

ON THE TITLE PAGE, ITEM [19] AND [76]

In the second line, please delete "Baroso-Lujan et al." and substitute therefor --Barroso-Lujan et al.--.

Under the heading "Inventors:" please delete "Baroso-Lujan" and substitute therefor --Barroso-Lujan--.

After the date filed, please add

--Foreign Application Priority Data

Mexico 9201422 Filed 3/30/92--.

Column 5

Claim 1, line 6, delete "mall" and substitute therefor --wall--.

Column 6

Claim 5, line 11, before "member" please insert --pusher--.

UNITED STATES PATENT AND TRADEMARK OFFICE

CERTIFICATE OF CORRECTION

PATENT NO. : 5,325,680

DATED : July 5, 1994

INVENTOR(S) : Barroso-Lujan et al.

It is certified that error appears in the above-identified patent and that said Letters Patent is hereby corrected as shown below:

Column 7

Claim 12, line 1, please delete "a" and substitute therefor --A--.

Signed and Sealed this

Thirteenth Day of June, 1995

*Attest:*

*Attesting Officer*

Bruce Lehman

BRUCE LEHMAN

*Commissioner of Patents and Trademarks*